US011408595B2

(12) United States Patent
Ninomiya

(10) Patent No.: US 11,408,595 B2
(45) Date of Patent: Aug. 9, 2022

(54) METHOD OF MOUNTING LIGHTING FIXTURE, LIGHTING SET, AND MOUNTING PLATE

(71) Applicant: NICHIA CORPORATION, Anan (JP)

(72) Inventor: Susumu Ninomiya, Niigata (JP)

(73) Assignee: NICHIA CORPORATION, Anan (JP)

( * ) Notice: Subject to any disclaimer, the term of this patent is extended or adjusted under 35 U.S.C. 154(b) by 0 days.

(21) Appl. No.: 17/213,825

(22) Filed: Mar. 26, 2021

(65) Prior Publication Data

US 2021/0302010 A1 Sep. 30, 2021

(30) Foreign Application Priority Data

Mar. 27, 2020 (JP) ..... JP2020-057423

(51) Int. Cl.

| | |
|---|---|
| ***F21V 21/04*** | (2006.01) |
| ***F21V 21/096*** | (2006.01) |
| ***F21S 4/28*** | (2016.01) |
| ***F21S 8/02*** | (2006.01) |

(52) U.S. Cl.

CPC ..... *F21V 21/048* (2013.01); *F21V 21/049* (2013.01); *F21V 21/096* (2013.01); *F21S 4/28* (2016.01); *F21S 8/026* (2013.01)

(58) Field of Classification Search

CPC .... F21V 21/048; F21V 21/049; F21V 21/096; F21S 4/28; F21S 8/26; F21S 8/026

USPC ..... 362/147

See application file for complete search history.

(56) References Cited

U.S. PATENT DOCUMENTS

| | | | | |
|---|---|---|---|---|
| 10,151,462 | B1 * | 12/2018 | Satterfield | F21S 8/026 |
| 2014/0226316 | A1 * | 8/2014 | Medendorp, Jr | F21V 21/02 362/147 |
| 2016/0053973 | A1 * | 2/2016 | Tress | F21S 4/28 362/217.02 |
| 2017/0009946 | A1 * | 1/2017 | Jimbo | F21V 17/04 |
| 2018/0087728 | A1 * | 3/2018 | Leichner | F21S 8/036 |
| 2019/0101267 | A1 | 4/2019 | Lu et al. | |

FOREIGN PATENT DOCUMENTS

| | | | |
|---|---|---|---|
| JP | H07-99006 | A | 4/1995 |
| JP | 2005-100865 | A | 4/2005 |
| JP | 2018-055774 | A | 4/2018 |
| JP | 2019-067742 | A | 4/2019 |
| JP | 2020-047607 | A | 3/2020 |

* cited by examiner

*Primary Examiner* — Laura K Tso

(74) *Attorney, Agent, or Firm* — Mori & Ward, LLP

(57) ABSTRACT

A lighting fixture assembly for mounting to a structural body includes a mounting plate and a lighting fixture. The mounting plate has a lower side surface configured to receive the light fixture, and an upper side surface configured to mount to the structural body. The mounting plate has a recessed portion formed in a center portion of the mounting plate and extends longitudinally along the mounting plate. The recessed portion has a depth when viewed from the lower side surface of the mounting plate in a thickness direction. The lighting fixture comprises a chassis configured to be fixed to the mounting plate and one or more light sources mounted on the chassis. The depth of the recessed portion is equal to or less than a distance between an outer surface of the cover and an upper side surface of the chassis when viewed in the thickness direction.

17 Claims, 7 Drawing Sheets

METHOD OF MOUNTING LIGHTING FIXTURE, LIGHTING SET, AND MOUNTING PLATE

CROSS-REFERENCE TO RELATED APPLICATION

This application claims priority to Japanese Patent Application No. 2020-057423, filed on Mar. 27, 2020, the disclosure of which is hereby incorporated by reference in its entirety.

BACKGROUND

The present disclosure relates to a method of mounting a lighting fixture in a building, a lighting set for mounting a lighting fixture in a building, and a mounting plate for mounting a lighting fixture in a building.

Lighting is an indispensable element not only in office buildings, plants, and commercial facilities but also in nearly all buildings. Structures such as buildings, etc., are constructed by the work proceeding from foundation work through framework construction, finishing work, and equipment installation; and electrical equipment such as lighting, air conditioning, etc., are mounted to the ceiling after the framework is completed.

When mounting lighting to the ceiling, workers work on stepladders or in a space above a ceiling. Such a work to be performed under limitation in motion compared to normal is preferably simple rather than complex.

JP-A H7-99006 (Kokai) describes a lighting appliance to be mounted to a ceiling inside a tunnel, etc., the lighting appliance configured to be easily mounted and detached.

SUMMARY

A light fixture assembly in an embodiment includes a mounting plate configured to be mounted to a structural body. The mounting plate comprises a lower side surface that is configured to receive a light fixture. The mounting plate further comprises an upper side surface configured to mount to the structural body. The mounting plate has a first length that extends in a longitudinal direction of the mounting plate. The mounting plate also has a second length that extends in a width direction of the mounting plate. The first direction is greater than the second direction. In some implementations, the first direction is an order of magnitude greater than the second direction. The mounting plate further comprises a recessed portion formed in a center portion of the mounting plate. The recessed portion extends longitudinally along the mounting plate in the longitudinal direction. The recessed portion comprises a predetermined depth in a thickness direction when viewed from the lower side surface of the mounting plate. The lighting fixture assembly further comprises a lighting fixture. The lighting fixture comprises a chassis configured to be fixed to the mounting plate. The lighting fixture further comprises one or more light sources mounted on the chassis, and a cover configured to cover the one or more light sources. A distance between an outer surface of the cover and an upper side surface of the chassis in the thickness direction is a first thickness. The predetermined depth of the recessed portion is equal to or greater than a first depth dimension, and is equal to or less than the first thickness. In certain implementations, the first thickness is three centimeters or less.

In some implementations, the recessed portion of the mounting plate further comprises a plurality of second recessed portions, each of the plurality of second recessed portions having a depth in the thickness direction when viewed from the lower side surface of the mounting plate. In further implementations, each of the plurality of second recessed portions is sized to receive a mounting member disposed on the chassis. In certain implementations, the mounting member disposed on the chassis is a magnet, which may be a neodymium magnet. In some implementations, the predetermined depth is between about one centimeter and about three centimeters. In further implementations, the mounting plate has a weight between about one kilogram and about three kilograms. In certain implementations, the mounting plate further comprises a first fastener and a second fastener. Each of the first and second fasteners are laterally disposed on each side of the mounting plate in the width direction. In some implementations, the fasteners are connected to the mounting plate by at least one of a screw and a bonding agent. In further implementations, the fasteners are integrally molded to the mounting plate.

In an embodiment, a mounting plate for a lighting fixture is configured to be mounted to a structural body comprises a lower side surface. The lower side surface is configured to receive the lighting fixture. The mounting plate further comprises an upper side surface configured to mount to the structural body. The mounting plate comprises a first length in a longitudinal direction and a second length in a width direction. The first length is greater than the second length. In some implementations, the first length is greater than the second length by an order of magnitude. The mounting plate further comprises a recessed portion formed in a center portion of the mounting plate. The recessed portion extends longitudinally along the mounting plate in the longitudinal direction. The recessed portion comprises a predetermined depth in a thickness direction when viewed from the lower side surface of the mounting plate.

In some implementations, the recessed portion of the mounting plate further comprises a plurality of second recessed portions, each of the plurality of second recessed portions having a depth in the thickness direction when viewed from the lower side surface of the mounting plate. In some implementations, the predetermined depth is between about one centimeter and about three centimeters. In further implementations, the mounting plate has a weight between about one kilogram and about three kilograms. In certain implementations, the mounting plate further comprises a first fastener and a second fastener. Each of the first and second fasteners are laterally disposed on each side of the mounting plate in the width direction. In some implementations, the fasteners are connected to the mounting plate by at least one of a screw and a bonding agent. In further implementations, the fasteners are integrally molded to the mounting plate.

DETAILED DESCRIPTION OF EMBODIMENTS

Figure 1:
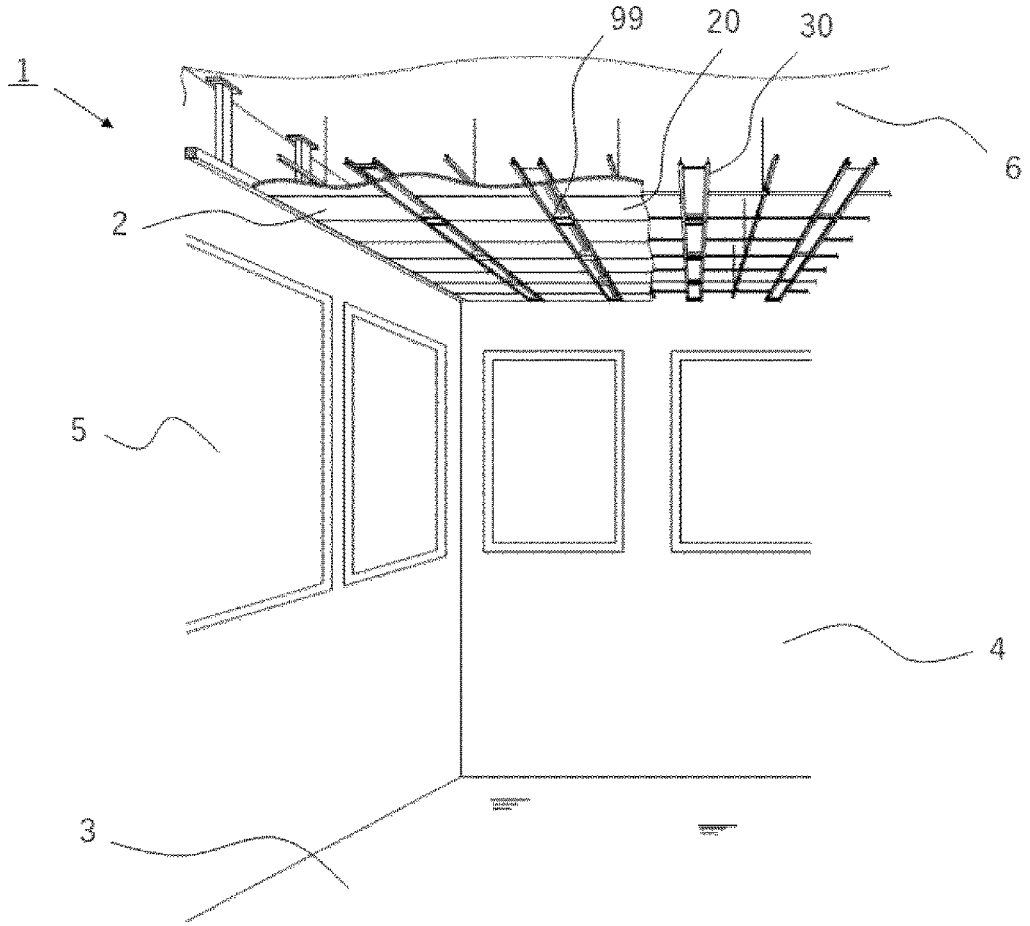
FIG. 1 is a schematic view for describing a structure of an occupiable room in which an existing lighting fixture is mounted in a building.

In the specification and the claims, polygonal shapes such as triangular shapes, rectangular shapes, etc., with modifications such as rounded corners, obtuse-angled corners, recessed corners formed by straight lines and/or curved lines, etc., will also be referred to as "polygonal shapes." The polygonal shape with modification at portions other than corners (ends of the sides), such as polygonal shapes with modifications at intermediate portions of sides, will also be referred to as "polygonal shapes." That is, a polygonal-based shape with partial modification is encompassed in the term "polygonal shape" recited in the specification and the claims.

This applies not only to a polygon but also to similar terms indicating designated shapes such as trapezoid, circle, unevenness, etc. This also applies to description of sides forming such shapes. That is, when an end or an intermediate portion of a side of such a shape is modified, the modified portion is construed as being included in the "side." When describing a "polygonal shape" or "side" without modified portions in order to distinguish from a shape with modified portions, such shapes will be described with the expression "strict"; for example, a "strictly rectangular shape" or the like.

In the specification and the claims, expressions such as vertical, lateral, front and back, forward and backward, frontward, inward, etc., merely describe the relationships of relative position, orientation, direction, etc., and may not match the relationships of position, orientation, direction, etc., in actual use.

In the specification and the claims, when there are a plurality of the same components, these components may be separately designated using terms "first", "second", etc. Also, when the perspectives of designation and/or objects to be designated are different between the specification and the claims, the same term does not necessarily refer to the same object between the specification and the claims.

For example, when there are components that are separately designated using terms "first", "second", and "third" in the specification and the claims recite only components corresponding to the "first" and "third" components of these components in the specification, the components in the claims corresponding to the "first" and "third" components in the specification may be designated as "first" and "second" components, respectively, for ease of understanding. In such a case, the components designated using the terms "first" and "second" in the claims refer to the components designated using the terms "first" and "third", respectively, in the specification.

Certain embodiments of the present invention will be described below with reference to the drawings. However, the embodiments described below are intended to give a concrete form to the technical idea of the present invention and are not intended to limit the scope of the present invention thereto. In the description below, the same names and reference numerals refer to the same or similar members, and detailed description thereof may be omitted appropriately. The sizes, positional relationships, and the like of the members shown in the drawings may be exaggerated to clarify the description.

Embodiment

A mounting process of a lighting fixture according to one embodiment will be described using an example in which an existing lighting fixture that is mounted is replaced with the lighting fixture according to the present embodiment. FIG. 1 is a schematic view for describing an example of the structure of an occupiable room in a building 1 according to the present embodiment. An occupiable room is shown in the building 1 shown in FIG. 1 in a state in which an existing lighting fixture 99 is mounted. FIG. 1 shows a portion of a ceiling 2 without illustration of the lighting fixture 99 and ceiling materials 20 for convenience of description of the structure of the ceiling space. the ceiling space is a space above the ceiling 2.

The building 1 includes passageways and occupiable rooms, and has a multi-story structure such as a general office building. The building 1 according to the present embodiment does not necessarily have such structure and may be, for example, a one-story building. The building may be constructed underground such as premises of a subway station. The lighting fixture 99 to be replaced is not limited to being mounted in an occupiable room and may be mounted in a passageway, a restroom, etc.

The building 1 includes a space having the ceiling 2 as a surface defining a top of the space and a floor 3 as a surface defining a bottom of the space. In the description below, the space having the ceiling 2 as the surface defining the top of the space and the floor 3 as the surface defining the bottom of the space will be referred to as a "front-side space." In the building 1 of FIG. 1, the front-side space is the occupiable room. Lateral surfaces defining the front-side space, are provided with walls 4 and windows 5. The lateral surfaces may not be provided with windows.

The building 1 also includes a space having the ceiling 2 as a surface defining a bottom of the space and a framework 6 as a surface defining a top of the space. In the description below, the space having the ceiling 2 as the surface defining the bottom of the space and the framework 6 as the surface defining the top of the space will be referred to as a "back-side space." In the building 1, the space behind the ceiling 2 is the ceiling space. In the back-side space, the framework 6 is formed at the lateral surfaces. The walls 4 that form the lateral surfaces defining the front-side space and the framework 6 that forms the lateral surfaces defining the back-side space may be the same object.

The front-side space also can be referred to as a space below the ceiling 2, with the ceiling 2 serving as a portion defining the space. The back-side space also can be referred to as a space above the ceiling 2, with the ceiling 2 serving as a portion defining the space.

A ceiling surface that is formed by disposing the ceiling materials 20 at the ceiling foundation is the boundary between the front-side space and the back-side space. The ceiling foundation is formed of securing members 30 such as T-bars or the like connected to suspension members connected to ceiling insertions of the framework 6. A plurality of suspension members are connected to the framework 6, and a plurality of securing members 30 are connected to the plurality of suspension members.

The plurality of securing members 30 are arranged with predetermined spaces. Accordingly, a plurality of linear shaped frames that are arranged at uniform spaces are formed in the ceiling foundation. Further, in the ceiling foundation, additional plurality of securing members 30 are mounted to be orthogonal to the linear shaped frames to form a lattice-shaped frame. The ceiling surface is formed by the ceiling materials 20 being disposed in the lattice sections of lattice-shaped frame.

That is, the ceiling foundation includes, along a plane parallel to the ceiling surface, the plurality of securing members 30 that extend in one direction (a first direction) along the ceiling surface, and the plurality of securing members 30 that extend in a direction (a second direction) orthogonal to the first direction. In the example of FIG. 1, the ceiling foundation includes the lattice-shaped frame in the region in which the ceiling materials are located, and pairs of linear shaped frames extending at uniform spacing in the region in which the lighting fixtures 99 are located.

The plurality of ceiling materials 20 are mounted to the ceiling foundation such that the surfaces facing the front-side space are aligned. That is, the surfaces of the plurality of ceiling materials 20 facing the front-side space are in the same plane, and the plane is used as the ceiling surface. A plurality of ceiling surfaces that are at different heights may be formed in a single occupiable room.

One or more lighting fixtures 99 are mounted to the ceiling 2. The lighting fixture 99 is secured to the securing member 30. One or more air conditioners also may be included in the ceiling 2. One or more speakers, one or more sprinklers, one or more emergency lights, etc., also may be included.

A plurality of electrical wirings that are passed through piping is in the back-side space to supply power to electrically connected equipment such as air conditioners, the lighting fixtures 99, etc. Communication wiring for network connections also may be provided in the back-side space.

Figure 2:
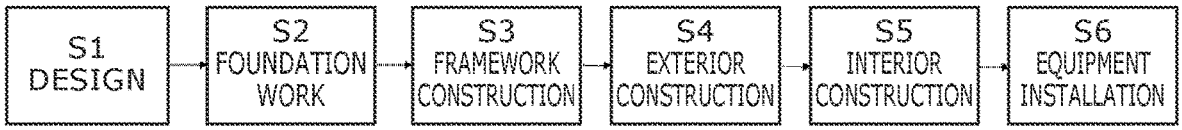
FIG. 2 is a flowchart for describing processes through a construction of the building.

FIG. 2 is a flowchart for describing the processes through the construction of the building 1. In the description below, a typical example of construction from the state of a vacant lot until the building 1 is constructed. The building 1 illustrated in FIG. 1 also can be constructed according to this flow.

When constructing a large-scale building such as an office building, a general contractor is contracted to order the construction work and perform the coordination of the entire construction work performed by various subcontractors. This is because the work content that is performed in each process requires the work of appropriate workers from among the workers of various subcontractors such as civil engineering workers, electrical workers, piping workers, etc.

First, architects and/or designers design the building (step S1). In this step, the layout of the passageways and the occupiable rooms, etc., are determined, and the overall design of the building 1 is recorded in design drawings. Also, the construction materials and the electrical equipment materials such as lighting fixtures, etc., that will be employed are somewhat determined; the locations of these materials also are recorded in the drawings.

Then, based on the determined design, the construction materials and the construction machinery are prepared, and the foundation work is performed (step S2). In this step, piling and/or earthwork are performed to ensure a stable foundation that can withstand the load of the building. In an example herein, the work is mainly performed by workers of the subcontractor performing the civil engineering work. Workers of other subcontractors also perform this work.

Then, framework construction is performed to form the framework of the building on the stable foundation (step S3). When a foundation part and/or basement floors are to be formed, the framework construction starts from the construction of the underground portions and proceeds to the above-ground floors. Pouring concrete, erecting columns, assembling the steel frame, etc., are performed, and the framework 6 (the structure framework) that is the framework of the entire building is completed. Also, concrete is poured in the exterior walls, the rooftop, the floor of each story, etc., as well.

Also, in the framework construction, inserts for connecting the suspension members such as hanger bolts, etc., in the subsequent interior construction are embedded in the structural materials forming the structure framework. For example, ceiling inserts for fixing the hanger bolts are fixed as a portion of the floor slab (the reinforced concrete floorboard, etc.) when pouring the slab of the story above. In the example herein, the work is mainly performed by workers of the subcontractor performing the civil engineering work, workers of the subcontractor performing the concreting, etc.

Then, exterior construction of the building is performed (step S4). The exterior form of the building 1 is formed through the exterior construction. Tiling of the exterior walls, window sashes, windowpanes, curtain walls, etc., are mounted. Also, painting, etc., are performed.

Next, interior construction is performed (step S5). The floor 3, the wall 4 and the ceiling 2 are formed in the interior construction. In the ceiling construction of mounting the ceiling 2, suspension members are connected to ceiling inserts provided in the framework construction of step S3, and the ceiling foundation is formed by connecting the securing members 30 to the suspension members. Then, the ceiling materials 20 is mounted to the ceiling foundation, so that the ceiling 2 is formed. For example, the ceiling materials 20 are caught on T-bars, which are the securing members 30, and are thus mounted to the ceiling foundation.

Instead of installing the ceiling inserts when pouring the concrete, it is also possible to fix the suspension members to the framework 6 by driving anchors into the concrete after pouring. Also, in the interior construction, the work of suspending piping and air conditioning ducts and the work of passing electrical wiring through the piping also are performed before completing the formation of the ceiling made of the ceiling materials 20. The work of providing the electrical wiring in the back-side space also is performed. At this time, the electrically connected equipment such as the lighting fixtures, etc., are not mounted to the ceiling.

In the wiring work of providing the electrical wiring, a necessary number of electrical wiring is provided based on the design drawings. The number of the necessary electrical wiring is determined according to the number of mounted electrically connected equipment such as the air conditioners mounted to the ceiling space, the lighting fixtures, etc. The wiring work may be performed after the mounting of the ceiling materials 20 is completed.

In the example herein, the work of duct installation inside the ceiling and mounting the ceiling materials 20 is performed by workers of a subcontractor performing the interior construction, etc. On the other hand, due to the danger of electric shock, etc., an expert worker that is allowed to perform electrical work performs the work of providing the electrical wiring. For example, in Japan, electrical work such as wiring work or the like is not permitted by a person not having the qualification of a licensed electrician.

When the interior construction is finished, next, installation work is performed (step S6). In the installation work, various equipment that is necessary when actually utilizing the building is installed. For example, the equipment for electricity, gas, service water lines, drainage, air conditioning, toilets, emergency, loudspeakers, etc., and the equipment of lighting, escalators, elevators, etc., are provided. This work is performed by workers of businesses of electrical work, telecommunication work, waterworks construction, firefighting facility construction, cleaning facility construction, etc.

In lighting installation work, the lighting fixtures 99 are mounted to the ceiling 2. The worker secures the lighting fixtures 99 to the securing members 30 to mount the lighting fixtures 99 to the ceiling 2. The lighting fixtures 99 are stably fixed to the framework 6 by the securing members 30 connected to the suspension members.

The work of electrically connecting the electrically connected equipment and the electrical wiring also is performed when mounting the electrically connected equipment such as the air conditioners, the lighting fixtures, etc. This allows the electrically connected equipment to be electrically connected to an external power supply via the electrical wiring and can receive the supply of electrical power from the external power supply.

The work of the electrical connections between the electrical wiring and the electrically connected equipment was performed by an expert worker that is allowed to perform electrical work when the work is in danger of electric shock, etc. In general, the installation work of a conventional lighting fixture is performed by an expert worker. As will be described below, in the mounting process of the lighting fixture according to the present embodiment, the work at this stage can be performed even by a worker that is not an expert worker allowed to perform the electrical work.

Figure 3:
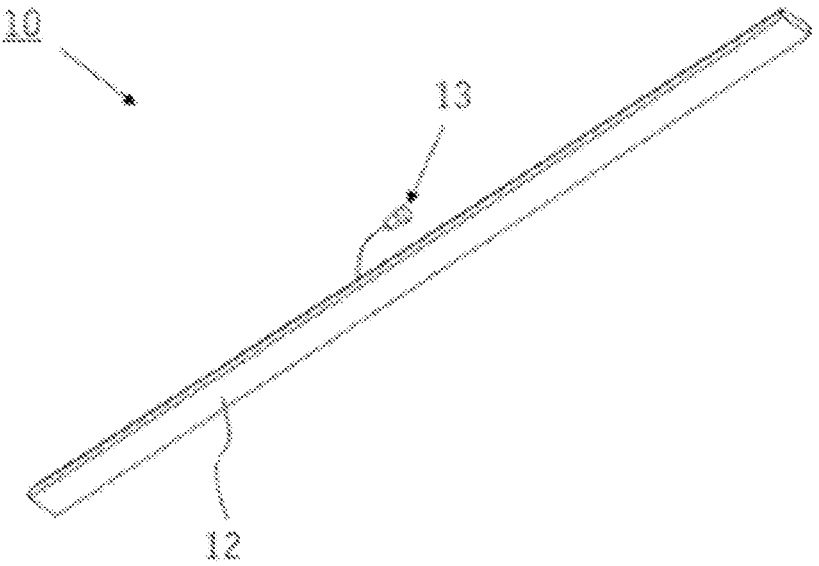
FIG. 3 is a schematic perspective view of a lighting fixture according to one embodiment.
Figure 4:
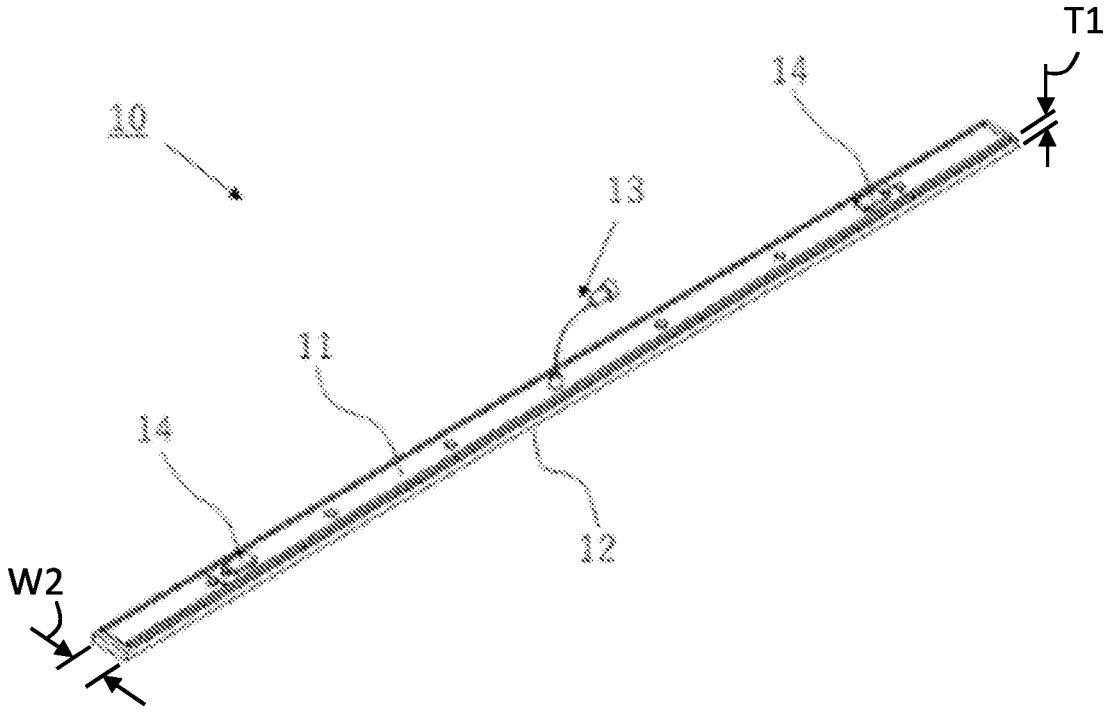
FIG. 4 is a schematic perspective view of a lighting fixture according to one embodiment.

A lighting fixture 10 and a mounting plate 50 according to the present embodiment will be described. FIGS. 3 and 4 are schematic views showing an example of the lighting fixture 10 according to the present embodiment. FIG. 3 is a perspective view of the lighting fixture 10 when viewed from the major irradiation surface side, and FIG. 4 is a perspective view of the lighting fixture 10 when viewed from the mounting surface side.

Figure 5:
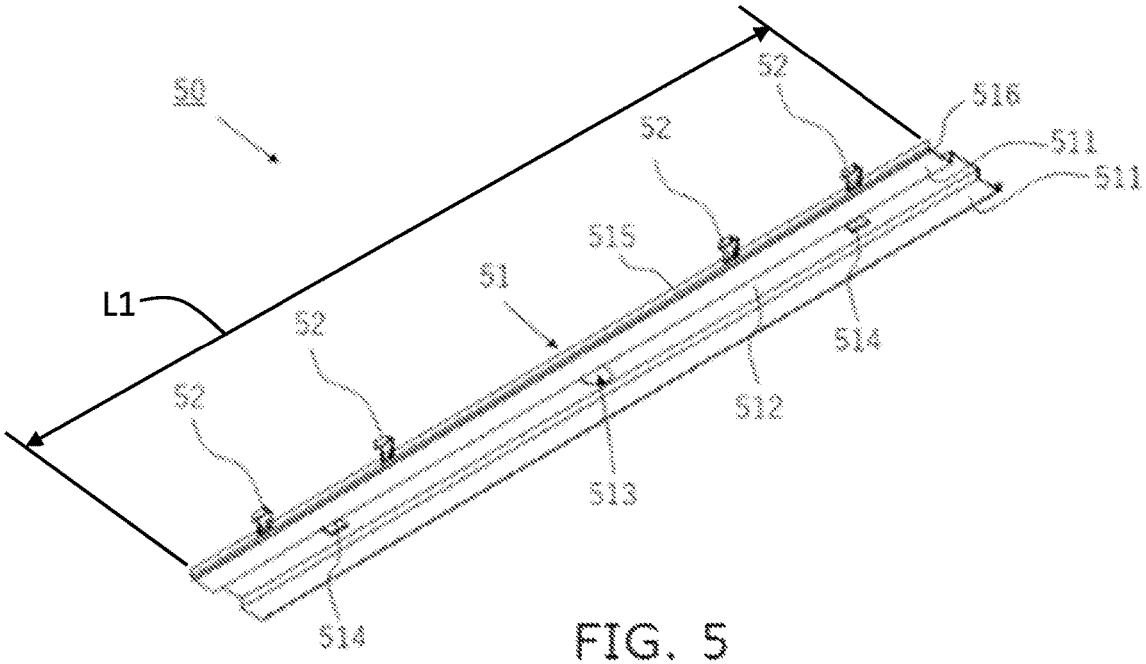
FIG. 5 is a schematic view of a mounting plate according to one embodiment.
Figure 6:
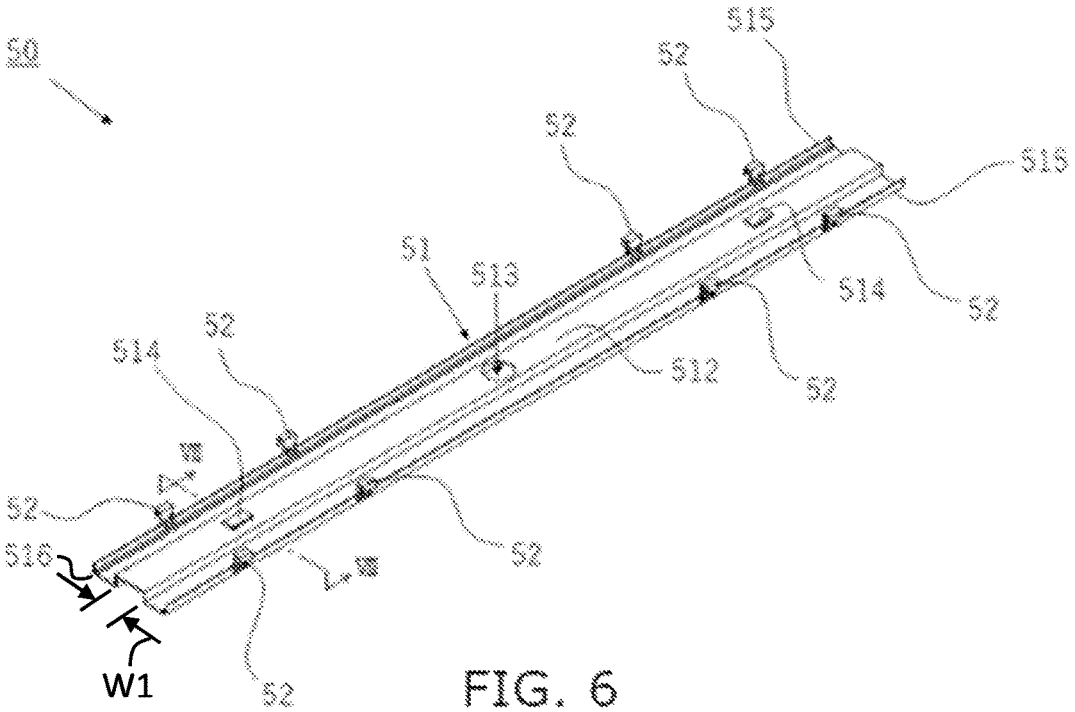
FIG. 6 is a schematic view of a mounting plate according to one embodiment.
Figure 7:
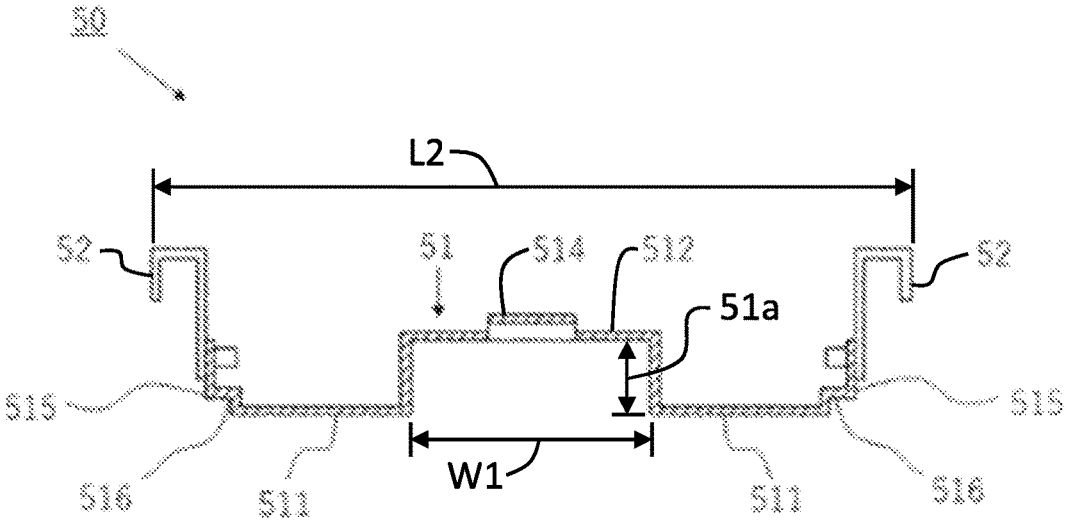
FIG. 7 is a cross-sectional view of the mounting plate according to one embodiment along line VII-VII of FIG. 6.

FIGS. 5 to 7 are schematic views showing an example of the mounting plate according to the present embodiment. FIG. 5 is a schematic perspective view of the mounting plate 50 when viewed from the lighting mounting surface side, and FIG. 6 is a schematic perspective view of the mounting plate 50 when viewed from the ceiling mounting surface side. FIG. 7 is a cross-sectional view of the mounting plate 50 along line VII-VII of FIG. 6.

The lighting fixture 10 includes one or more light sources and is configured to emit illumination light to the outside based on the light emitted from the one or more light sources. The lighting fixture 10 also includes a chassis 11, a cover 12, an electrical connection part 13, and a mounting member 14. In some implementations, mounting member 14 is a magnet. The lighting fixture 10 includes a plurality of mounting members 14. The illustrative lighting fixture 10 shown in FIG. 3 includes two magnets 14.

The chassis 11 includes a placement surface (a first surface) at which the one or more magnets 14 are located. The chassis 11 also includes a surface (a second surface) at a side opposite to the first surface. The one or more light sources are disposed at the second surface side. The chassis 11 is, for example, a metal plate and functions as a heat dissipation plate configured to dissipate heat generated from the light source.

The cover 12 is connected to the chassis 11 to cover the one or more light sources located at the second surface side of the chassis 11. The one or more light sources are located in a space surrounded with the chassis 11 and the cover 12.

The cover 12 includes a major surface that faces the second surface of the chassis 11 with the one or more light sources disposed between the cover 12 and the second surface of the chassis 11, and lateral surfaces that extend from the outer edge of the major surface toward the chassis 11 side. The cover 12 includes the same number of lateral surfaces as the number of sides forming the outer edge shape of the major surface. That is, the cover 12 includes one or more lateral surfaces corresponding to the outer edge shape of the major surface. The lighting fixture 10 shown in FIG. 3 includes a rectangular major surface and four lateral surfaces corresponding to the major surface.

The major surface of the cover 12 serves as a major irradiation surface through which the light emitted from the one or more light sources is externally irradiated. That is, the major surface of the cover 12 serves as the major light-emitting surface of the lighting fixture 10. The lateral surfaces of the cover 12 also serve as irradiation surfaces through which light emitted from the one or more light sources is externally irradiated.

The major surface of the cover 12 is transmissive to the light emitted by the one or more light sources. The one or more lateral surfaces of the cover 12 also are transmissive to the light emitted by the one or more light sources. The major surface of the cover 12 also is light-diffusing to the light emitted by the one or more light sources. The one or more lateral surfaces of the cover 12 also are light-diffusive to the light emitted by the one or more light sources.

The light that is emitted from the one or more light sources passes through the transmissive major surface of the cover 12 and is emitted outside the lighting fixture 10 as illumination light. Also, the light that is emitted from the one or more light sources passes through the transmissive the one or more lateral surfaces of the cover 12 and is emitted outside the lighting fixture 10 as illumination light. The lighting fixture 10 emits the illumination light to the outside from the major surface and the one or more lateral surfaces of the cover 12.

For example, the cover 12 can be formed of a transmissive resin member with titanium oxide or the like dispersed in the transmissive resin member. The cover 12 is milky white, or may be in another color.

Examples of the resin member include an acrylic resin; for example, a polymethyl methacrylate resin can be employed for the resin member.

The electrical connection part 13 is disposed at the first surface side of the chassis 11. The electrical connection part 13 is located in the central region of the chassis 11 in a top view. The electrical connection part 13 may be located in a region other than the central region of the first surface in a top view.

The electrical connection part 13 is an electrical connection port for receiving the supply of electrical power. The electrical connection part 13 is an example of an anti-shock connection part that prevents electric shock in the work of connecting the electrical wiring and an equipment such as a lighting fixture, etc., that is configured to be connected with electricity. With the use of such an anti-shock connection part, the equipment configured to be connected with electricity can be electrically connected in a state in which the safety for electric shock is ensured.

Examples of the electrical connection part 13 include a connector. The electrical connection part 13 can include wiring electrically connected to the one or more light sources, and a connection part (a connector) provided at the tip of the wiring. When the electrical connection part 13 includes wiring, it is favorable for the length of the wiring to be 100 cm or less. If the wiring is excessively long, in the mounting process of the lighting fixture described below, the wiring may obstruct the mounting, resulting in reduction in the work performance.

The mounting member 14 is located at the first surface of the chassis 11. The plurality of mounting members 14 are located at the first surface of the chassis 11. In some implementations, mounting member 14 is a magnet. In the illustrative lighting fixture 10 shown in FIG. 3, two magnets 14 are located at the first surface. The two magnets 14 are symmetrically arranged at the first surface of the chassis 11.

One mounting member of the two mounting members 14 is located more proximate to one end of the two ends in the longitudinal direction of the first surface than to the longitudinal-direction center of the first surface, and the other mounting member is located more proximate to the other end of the two ends in the longitudinal direction of the first surface than to the longitudinal-direction center of the first surface. In some implementations, mounting members 14 are permanent magnets. The magnets 14 contain, for example, neodymium.

In the lighting fixture 10, the distance in the thickness direction between the major surface of the cover 12 and the mounting surface of the chassis 11 defines a first thickness T1. In some implementations, the first thickness T1 is 3.0 cm or less. For example, the lighting fixture 10 can be made so that the first thickness T1 in the thickness direction is within the range of 1.5 cm or greater and 2.5 cm or less. The first thickness T1 in the thickness direction refers to the thickness of the lighting fixture 10 without the electrical connection part 13. In other words, the first thickness T1 in the thickness direction refers to a thickness between the major surface of the cover 12 and the first surface of the chassis 11. A lighting fixture that has a first thickness T1 greater than 3.0 cm can also be employed.

In a bottom view, the cover 12 of the lighting fixture 10 is within a rectangle of 15 cm×150 cm. The surface area of the cover 12 of the lighting fixture 10 is 400 $cm^2$ or greater and 2500 $cm^2$ or less in a bottom-view. The total luminous flux of the lighting fixture 10 is 1500 lm or greater. Favorably, the total luminous flux of the lighting fixture 10 is 1700 lm or greater.

As used herein, the minimum rectangle within which the external shape of the lighting fixture in a top view or a bottom view fits is referred to as an "enclosing rectangle of the lighting fixture." For example, the enclosing rectangle of the lighting fixture 10 shown in FIG. 3 has an elongated rectangular shape.

For example, when the lighting fixture 10 has a circular outer edge shape, the enclosing rectangle is a square formed by sides having a length same as the diameter of the circle. For example, when the lighting fixture 10 has an elliptic outer edge shape, the enclosing rectangle is a rectangle in which the length of the long side is the major diameter of the ellipse, and the length of the short side is the minor diameter of the ellipse.

The enclosing rectangle of the lighting fixture 10 is obtained from the lighting fixture 10 without the electrical connection part 13. For example, when the electrical connection part 13 includes a wiring, the direction in which the wiring extends can be changed; therefore, if the wiring is long, the size of the enclosing rectangle would change according to the direction in which the wiring extends. Accordingly, the enclosing rectangle of the lighting fixture is reasonably determined without the changeable components.

The enclosing rectangle of the lighting fixture 10 can be an elongated-rectangular shape. The lighting fixture 10 can have a rectangular shape in which the length in the long-side direction (a third direction) of the enclosing rectangle of the lighting fixture 10 is 3 times or greater the length in the short-side direction (a fourth direction) of the enclosing rectangle of the lighting fixture 10. Also, the enclosing rectangle of the lighting fixture 10 can be a rectangle such that the length in the third direction is in the range of 3 times or greater and 25 times or less the length in the fourth direction. The enclosing rectangle of the lighting fixture 10 may be a square.

The weight of the lighting fixture 10 is 1.5 kg or less. Also, the weight of the lighting fixture 10 is 0.5 kg or greater. The weight of the lighting fixture 10 may be greater than 1.5 kg and less than 0.5 kg.

Several specific examples of the lighting fixture according to the present embodiment will now be described. In a first example, the lighting fixture has a size of 60 mm×1195 mm×20 mm and a weight of 0.8 kg. In the lighting fixture in the first example, the length in the thickness direction is 20 mm, and the outer edge shape of the cover 12 of the lighting fixture 10 in a bottom view is a rectangle of 60 mm×1195 mm.

In a second example, the lighting fixture has a size of 60 mm×1000 mm×20 mm. In the lighting fixture in the second example, the length in the thickness direction is 20 mm, and the outer edge shape of the cover 12 of the lighting fixture 10 in a bottom view is a rectangle of 60 mm×1000 mm.

In a third example, the lighting fixture has a size of 60 mm×900 mm×20 mm. In the lighting fixture in the third example, the length in the thickness direction is 20 mm, and the outer edge shape of the cover 12 of the lighting fixture 10 is a rectangle of 60 mm×900 mm in a bottom view.

In a fourth example, the lighting fixture has a size of 60 mm×800 mm×20 mm. In the lighting fixture in the fourth example, the length in the thickness direction is 20 mm, and the outer edge shape of the cover 12 of the lighting fixture 10 is a rectangle of 60 mm×800 mm in a bottom view.

As shown in illustrative FIG. 5, the mounting plate 50 has a first length L1 that extends in a longitudinal direction. Mounting plate 50 also has a second length L2 that extends in a width direction (see, e.g., FIG. 7). The first length L1 is greater than the second length L2. In some implementations, the first length L1 is an order of magnitude greater than the second length L2. The mounting plate 50 includes a plate part 51 and a fastener 52. The mounting plate 50 may include a plurality of fasteners 52. One or more fasteners 52 may be connected to the plate part 51. In some implementations, mounting plate 50 further comprises a first fastener and a second fastener 52. Each of the first and second fasteners is laterally disposed on each side of the mounting plate 50 in the width direction. The fastener 52 may be fixed to the plate part 51 by screwing. The fastener 52 may be connected to the plate part 51 by using a technique other than screwing. For example, a bonding agent may be used. Alternatively, the plate part 51 and the fastener 52 may be integrally molded.

The plate part 51 includes a lowermost surface 511, a recessed-shape part 512 (a recessed portion) defining a recess that is recessed upward with a predetermined depth 51*a* from the lowermost surface 511 when viewed from the lower surface side. The plate part 51 also includes a recessed-shape part 514 (a second recessed portion) defining a recess that is recessed upward from the recessed portion when viewed from the lower surface side. When viewed from the upper surface side, the recessed portion of the plate part 51 can be considered as a protrusion part (a first protrusion part) defining a protrusion protruding upward from the lowermost surface 511. The second recessed portion of the plate part 51 can be considered as a protrusion part (a second protrusion part) defining a protrusion protruding upward from the first protrusion part.

A through-hole 513 is formed in the plate part 51. The through-hole 513 is formed in the recessed portion of the plate part 51. That is, the through-hole 513 is surrounded with the recessed portion. The through-hole 513 may be formed in a location other than the recessed portion, e.g., the lowermost surface 511, etc.

The plate part 51 also includes an outermost lateral surface 515 extending further upward with respect to the lowermost surface 511. A through-hole is formed in the outermost lateral surface 515. The plate part 51 also includes a step part 516 between the outermost lateral surface 515 and the lowermost surface 511.

The plate part 51 includes two regions at two opposite sides of the recessed portion. The lowermost surfaces 511 are formed in these regions. In the mounting plate 50 that is illustrated in the drawings, the lowermost surfaces 511 are formed respectively in the two regions at the two opposite sides of the recessed portion. The lowermost surfaces 511 that are formed respectively in the two regions at the two opposite sides of the recessed portion are not connected along a plane including the lowermost surfaces 511.

A lowermost surface that is formed in the two regions at the two opposite sides of the recessed portion and is connected along the same plane may be formed. For example, such a lowermost surface can be realized with the lowermost surface 511 surrounding the entire perimeter of the outer edge shape of the recessed portion in a bottom view.

The lowermost surface 511 can be a flat surface. The lowermost surface 511 is not necessarily a flat surface and may be, for example, a curved surface. The lowermost surfaces 511 that are formed in the two regions at the two opposite sides of the recessed portion meet the recessed portion.

The recessed portion includes an upper surface and two lateral surfaces that form the recess. The upper surface of the recessed portion intersects the two lateral surfaces. The two lateral surfaces face each other via the upper surface of the recessed portion. The two lateral surfaces are parallel to each other. The two lateral surfaces are perpendicular to the upper surface of the recessed portion. As used herein, the parallel and perpendicular configurations can include deviation within 1.0 degrees. The two lateral surfaces of the recessed portion meet the lowermost surfaces 511.

The predetermined depth 51*a* of the recessed portion is configured to be equal to or greater than a first depth dimension, and equal to or less than the first thickness. In some implementations, the predetermined depth 51*a* is 1.0 cm or greater and 3.0 cm or less. With such a range of a depth of the first recess in the plate part 51, the lateral surfaces support the load applied downward, and deformation of the plate part 51 can be reduced compared to when the recessed portion is not formed. The recess of the recessed portion may have a depth that is less than 1.0 cm, or may have a depth that is greater than 3.0 cm.

In the present specification, the minimum rectangle that encloses the larger outer edge shape of the outer edge shape of the recessed portion in a bottom view or the outer edge shape of the recessed portion in a top view will be referred to as an "enclosing rectangle of the recessed portion." The enclosing rectangle of the recessed portion can be a substantially elongated-rectangular shape. In the mounting plate 50 that is illustrated in the drawings, the recessed portion has a rectangular external shape in a bottom view.

The recessed portion can have a rectangular shape in which the length in the long-side direction (a fifth direction) of the enclosing rectangle of the recessed portion is 3 times or greater the length (also referred to herein as a first width W1 (see FIG. 7)) in the short-side direction (a sixth direction) of the enclosing rectangle of the recessed portion. The enclosing rectangle of the recessed portion is a rectangle such that the length in the fifth direction is in the range 3 times or greater and 25 times or less the length in the sixth direction (the first width W1). The enclosing rectangle of the recessed portion may be a square.

The length (the first width W1) in the sixth direction of the recessed portion in a bottom view is equal to the length (also referred to herein as a second width W2 (see FIG. 4)) in the fourth direction of the lighting fixture 10 in a top view or in a bottom view. The outer edge shape of the recessed portion in a bottom view is the same as the outer edge shape of the lighting fixture 10 in a top view or in a bottom view. The term "same" as used herein can include necessary variation in the design.

For example, when the lighting fixture 10 is disposed to be accommodated in the recessed portion, strictly, the outer edge shape of the recessed portion needs to be larger than the outer edge shape of the lighting fixture 10. Even when the recessed portion is designed to reduce the gap as much as possible, it is necessary to increase the recessed portion in consideration of tolerances, etc. The state that results when an excessive gap substantially does not occur in the recessed portion and the margin that is necessary for the design is provided is included in the interpretation of the "same" herein.

When the length (the second width W2) in the fourth direction of the lighting fixture is not constant along the third direction, the lighting fixture has an outer edge shape in which the length (the second width W2) in the fourth direction varies along the third direction, e.g., an elliptical outer edge shape, etc. Thus, when the length in the fourth direction (the second width W2) of the lighting fixture varies along the third direction, the variance of the length in the fourth direction (the second width W2) of the lighting fixture 10 along the third direction and the variance of the length in the sixth direction (the first width W1) of the first recess along the fifth direction are the same. For example, when the lighting fixture has an elliptical outer edge shape in a bottom view, the recessed portion also has an elliptical outer edge shape in a bottom view.

The second recessed portion includes an upper surface and one or more lateral surfaces. The upper surface of the second recessed portion meets the one or more lateral surfaces. The plate part 51 has one or more second recessed portions. When a plurality of second recessed portions are formed, the plurality of second recessed portion are positioned at the same distance from the center of the recessed portion. When the recessed portion is uniformly quadrisected in the fifth direction into four regions, at least one second recessed portion is formed in each of two outermost regions of the four regions.

A total of two second recessed portion is formed in the mounting plate 50 that is illustrated in the drawings. When the recessed portion is uniformly quadrisected in the long-side direction of the rectangular external shape into four regions, the two second recessed portions are formed respectively in two outermost regions of the four regions. The two second recessed portion are formed at the same distance from the center of the recessed portion (the position of the through-hole 513).

The lengths (the widths) in the fifth and sixth directions of the second recessed portion in a bottom view are equal to the lengths in the third and fourth directions, respectively, of the magnet 14 of the lighting fixture 10 in a top view or in a bottom view. That is, the outer edge shape of the second recessed portion in a bottom view is the same as the outer edge shape of the magnet 14 of the lighting fixture 10 in a top view. The term "same" as used herein can include necessary variations in the design.

The plate part 51 includes the two outermost lateral surfaces 515 opposite to each other. The two outermost lateral surfaces 515 face each other via the recessed portion. The two outermost lateral surfaces 515 are at the same distance to the recessed portion. The term "same" as used herein can include variations within 0.5 mm.

The two outermost lateral surfaces 515 face each other across the lowermost surfaces 511, which are formed respectively in the two regions across the recessed portion. Each of the two outermost lateral surfaces 515 faces, across the lowermost surface 511, the more proximate lateral surface of the two lateral surfaces of the recessed portion.

The outermost lateral surface 515 is formed along the fifth direction. The length of the outermost lateral surface 515 in the fifth direction is the length in the fifth direction of the plate part 51. The lengths in the fifth direction of the two outermost lateral surfaces 515 are the same. The term "same" as used herein can include variations within 1.0 mm.

The outermost lateral surface 515 is located above the lowermost surface 511. When the lowermost surface 511 is a curved surface, the outermost lateral surface 515 is located above the lowest portion of the lowermost surface 511. When the lowermost surface 511 is a curved surface, the outermost lateral surface 515 is located above the highest portion of the lowermost surface 511.

The two outermost lateral surfaces 515 are formed parallel to each other. The two lateral surfaces are formed perpendicular to the upper surface of the recessed portion. The parallel and perpendicular configurations as used herein can include deviation within 1.0 degrees.

The step part 516 is formed in the outer peripheral region of the plate part 51. The step part 516 is formed along the fifth direction. The step part 516 includes an upper surface, and a lateral surface extending downward from the upper surface. The side of the upper surface of the step part 516 that is opposite to the side of the upper surface of the step part 516 meeting the lateral surface of the step part 516 meets the outermost lateral surface 515. The lateral surface of the step part 516 meets the lowermost surface 511.

The length of the upper surface of in the sixth direction the step part 516 can be 4.0 mm or greater and 7.5 mm or less. The length may be less than 4.0 mm or greater than 7.5 mm. The length (the height of the step part) between the lowermost surface 511 and the upper surface of the step part 516 can be 2.0 mm or greater and 5.0 mm or less. The length may be greater than 5.0 mm.

The length (the height) of the plate part 51 in the vertical direction of the plate part 51 is 3.5 cm or less. In the mounting plate 50 that is illustrated in the drawings, the height of the plate part 51 is the distance between the lowermost surface 511 and the upper surface of the second recessed portion in a direction perpendicular to the upper surface of the recessed portion.

The fastener 52 is located above the lowermost surface 511. The fastener 52 includes a hook that is located above a portion connected with the plate part 51. The fastener 52 is connected to the outermost lateral surface 515 of the plate part 51. In some implementations, a fastener 52 is laterally disposed on each side of the mounting plate in the width direction. The fastener 52 is connected to the outermost lateral surface 515 of the plate part 51 by, for example, screwing with the through-hole of the outermost lateral surface 515 of the plate part 51. The fastener 52 also includes a hook extending outward of the plate part 51 from the portion connected with the plate part 51. The hook of the fastener 52 is located above the plate part 51.

In the mounting plate 50 that is illustrated in the drawings, the hook of the fastener 52 extends from the portion connected with the outermost lateral surface 515 to a position located above the second recessed portion of the plate part 51, then extends outward of the plate part 51, and then extends downward. The upper surface of the hook of the fastener 52 is located above the second recessed portion of the plate part 51.

The plurality of fasteners 52 are connected to a single outermost lateral surface 515 extending in the fifth direction. The plurality of fasteners 52 that are connected to the single outermost lateral surface 515 are uniformly located along the fifth direction. The plurality of fasteners 52 are connected uniformly to the two outermost lateral surfaces 515 facing each other.

In the mounting plate 50, it is preferable that the length of the lowermost surface 511 in the sixth direction between the recessed portion and the outermost lateral surface 515 to be 5.0 cm or greater and 30.0 cm or less. The length may be 5.0 cm or less. If the length is excessively great, the mounting plate 50 may deform between the two outermost lateral surface 515; however, the length may be greater than 30.0 cm if tolerable. The length of the lowermost surface 511 in the sixth direction is appropriately determined according to the opening width of the ceiling described below.

The mounting plate 50 can be formed using a magnetic material. For example, a steel plate can be used as a material when forming the mounting plate 50. The plate part 51 of the mounting plate 50 can be formed of a magnetic material. The fastener 52 of the mounting plate 50 may be formed of a material that is not a magnetic material.

The plate part 51 of the mounting plate 50 can be formed from a plate that has a thickness that is less than 3.0 mm, i.e., a thin plate. Using a thin plate can contribute to the weight reduction of the mounting plate 50. The plate part 51 may not be a thin plate. For example, a medium plate that has a thickness 3.0 mm or greater and less than 6.0 mm, etc., may be used.

The plate part 51 of the mounting plate 50 can be formed by, for example, processing a thin steel plate into the shape of the plate part 51. The thin steel plate is a material that has high processability for which processing such as bending, cutting, etc., are easy. The plate part 51 can be formed using a colored steel plate of which the surface when viewed from the lower surface side is painted. Surfaces of the illustrated plate part 51 that can be seen when viewed from the lower surface side of the plate part 51 can be painted white, or may be painted with a color other than white.

In the mounting plate 50, at least the upper surface of the second recessed portion is a magnetic region. Therefore, when a magnetic member (e.g., the magnet 14) is disposed in the recess defined by the second recessed portion of the mounting plate 50, the magnetic member adheres to the mounting plate 50. Examples of a technique for making the upper surface of the second recessed portion a magnetic region include forming the plate part 51 of a magnetic material and disposing a magnet at the upper surface of the second recessed portion. Even when the magnet is disposed, the magnet that is included in the mounting plate 50 does not protrude from the recess defined by the second recessed portion. That is, the magnet that is included in the mounting plate 50 is not present below the upper surface of the recessed portion.

The mounting plate 50 can have a weight of 1.0 kg or greater and 3.0 kg or less.

The weight of the mounting plate 50 may be greater than 3.0 kg or may be less than 1.0 kg.

Figure 8:
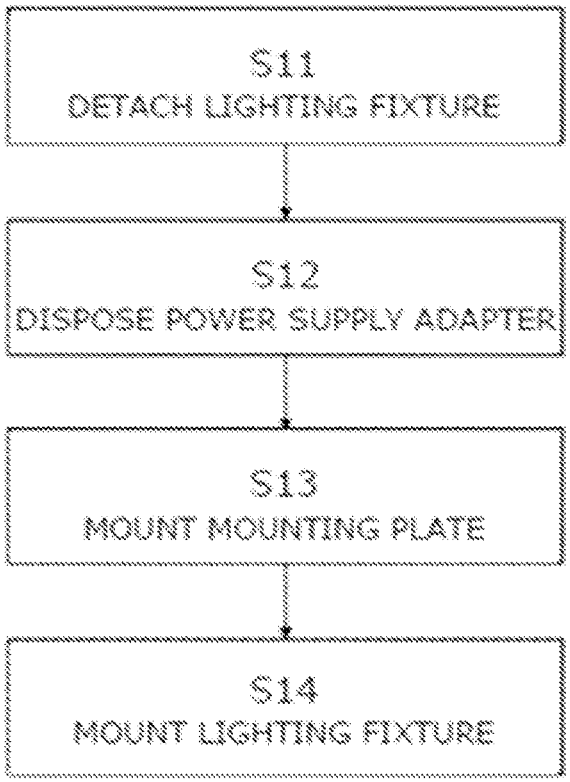
FIG. 8 is a flowchart for describing a mounting of the lighting fixture according to one embodiment.

A mounting process of the lighting fixture according to the present embodiment will now be described. FIG. 8 is a flowchart for describing an installation work in which the lighting fixture 99 already mounted in the building 1 constructed in the process of FIG. 2 is replaced with the lighting fixture 10. FIGS. 9 to 13 are schematic views showing states of the occupiable room in each step.

Figure 9:
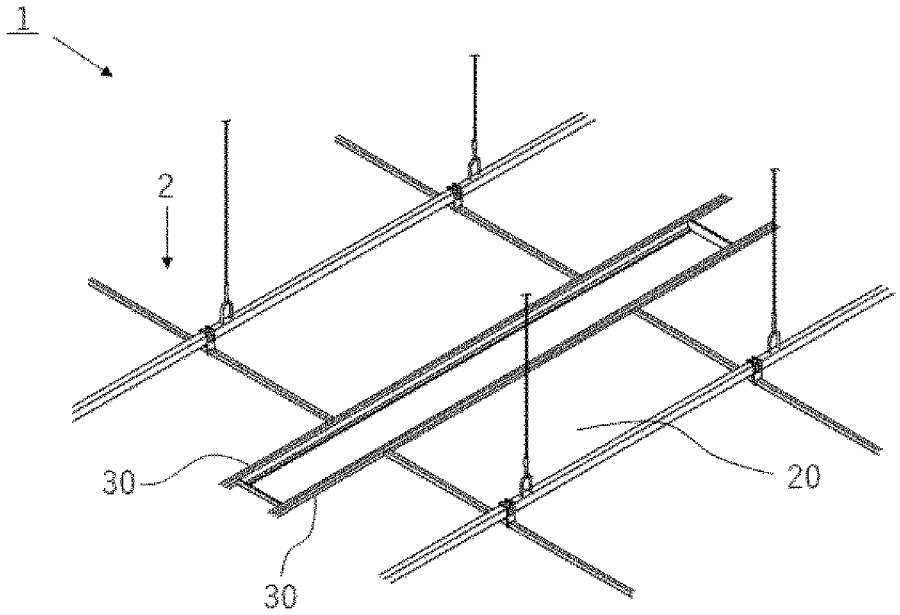
FIG. 9 is a schematic view showing a state in the flow of FIG. 8.

Work of detaching the lighting fixture 99 mounted to the ceiling 2 is performed (step S11). FIG. 9 shows the state in which the lighting fixture 99 is detached from the ceiling 2.

The lighting fixture 99 that is mounted to the ceiling 2 is mounted to the securing members 30 in the back-side space and secured. The lighting fixture 99 is connected to one electrical wiring 40 of the plurality of electrical wiring provided in the back-side space by the wiring work, and thus is electrically connected to the external power supply. Therefore, in this step, the work of detaching the lighting fixture 99 mounted to the ceiling 2 and the work of disconnecting, from the lighting fixture 99, the electrical wiring 40 connected to the lighting fixture 99 are performed.

In the work of disconnecting the electrical wiring 40 from the lighting fixture 99, for example, the electrical wiring 40 that is connected to the lighting fixture 99 is cut using a tool. In such a case, the work is performed by an expert worker that is allowed to perform electrical work because the exposed portion of the cutting surface may cause electric shock, etc. The disconnection may be performed using a technique other than cutting.

For the next process as well, it is preferable for the electrical wiring 40 to be cut at a position proximate to the lighting fixture 99 so that a sufficient length of wiring of the electrical wiring 40 is ensured. The cutting position of the electrical wiring 40 may be appropriately determined by the worker, but it is preferable for the electrical wiring 40 to be cut within 20 cm from the lighting fixture 99. For example, the electrical wiring 40 is cut at a position several cm from the base portion of the electrical wiring 40 connected to the lighting fixture 99.

The work of disconnecting the electrical wiring 40 from the lighting fixture 99 results in a state in which the lighting fixture 99 is not electrically connected to the external power supply.

A portion of the work of detaching the lighting fixture 99 mounted to the ceiling 2 may be performed by a worker that is not an expert worker allowed to perform electrical work, and the remaining work may be performed by an expert worker allowed to perform electrical work. Alternatively, all of the work may be performed by an expert worker that is allowed to perform electrical work.

Figure 10:
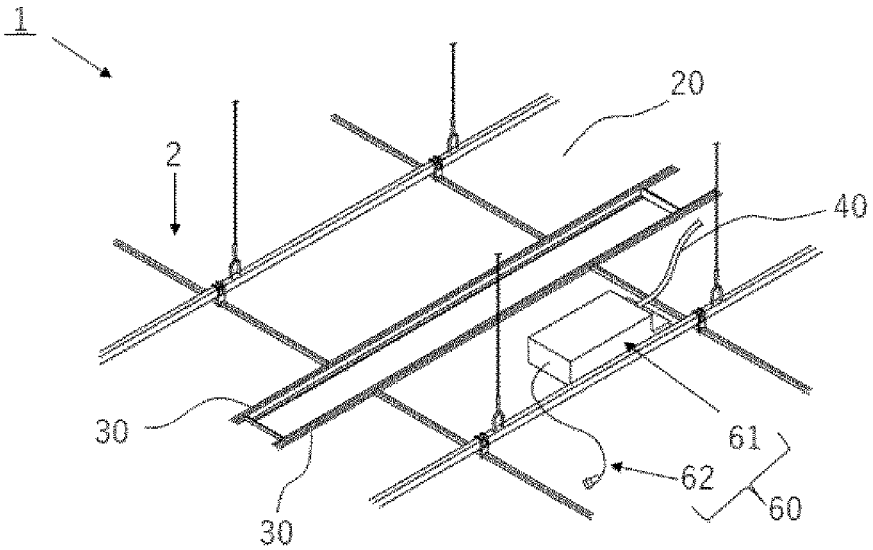
FIG. 10 is a schematic view showing a state in the flow of FIG. 8.

Then, a power supply adapter 60 is disposed in the back-side space (step S12). FIG. 10 shows a state in which the power supply adapter 60 is located in the back-side space.

The power supply adapter 60 is located in the back-side space in a state of being connected to the electrical wiring 40. For example, the worker connects the power supply adapter 60 and the electrical wiring 40 that is disconnected from the lighting fixture 99, and places the power supply adapter 60 and the electrical wiring 40 that are connected together proximate to the position where the lighting fixture 99 was detached. Because there is a danger of electric shock, etc., in this work, this work is performed by an expert worker that is allowed to perform electrical work.

The power supply adapter 60 includes an electrical connection part 62 utilized for the connection with the lighting fixture 10. The electrical connection part 62 is an example of an anti-shock connection part that prevents electric shock in the work of connecting the electrical wiring and electrically connected equipment such as a lighting fixture, etc. Using such an anti-shock connection part allows the electrically connected equipment to be electrically connected in a state in which the safety for electric shock is ensured.

Examples of the electrical connection part 62 include a connector. The electrical connection part 62 can include wiring extending from a main body 61 of the power supply adapter 60, and a connection part (a connector) provided at a tip of the wiring.

Instead of connecting the power supply adapter 60 to the electrical wiring 40 disconnected from the lighting fixture 99, an additional electrical wiring may be provided. Alternatively, the power supply adapter 60 may be connected to electrical wiring of the plurality of existing electrical wirings other than the electrical wiring 40 disconnected from the lighting fixture 99 may be connected.

It is preferable that the electrical wiring 40 previously connected to the lighting fixture 99 is connected to the power supply adapter 60 that is to be connected to the lighting fixture 10 that will be newly mounted, the lighting fixture 10 being to be mounted at the position where the lighting fixture 99 is previously mounted. With such a connection, when collectively controlling a plurality of lighting fixtures mounted in a predetermined area, erroneous operation such as controlling an unintended lighting fixture can be prevented.

Figure 11:
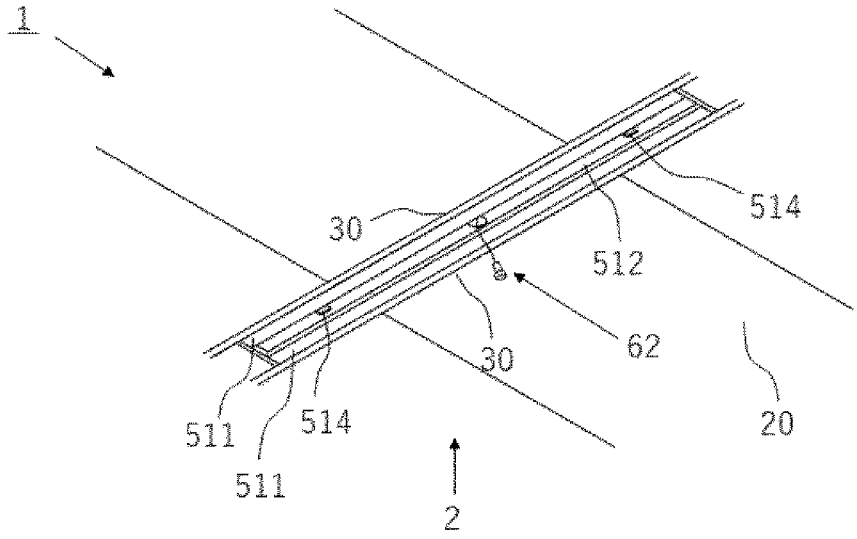
FIG. 11 is a schematic view showing a state in the flow of FIG. 8.
Figure 12:
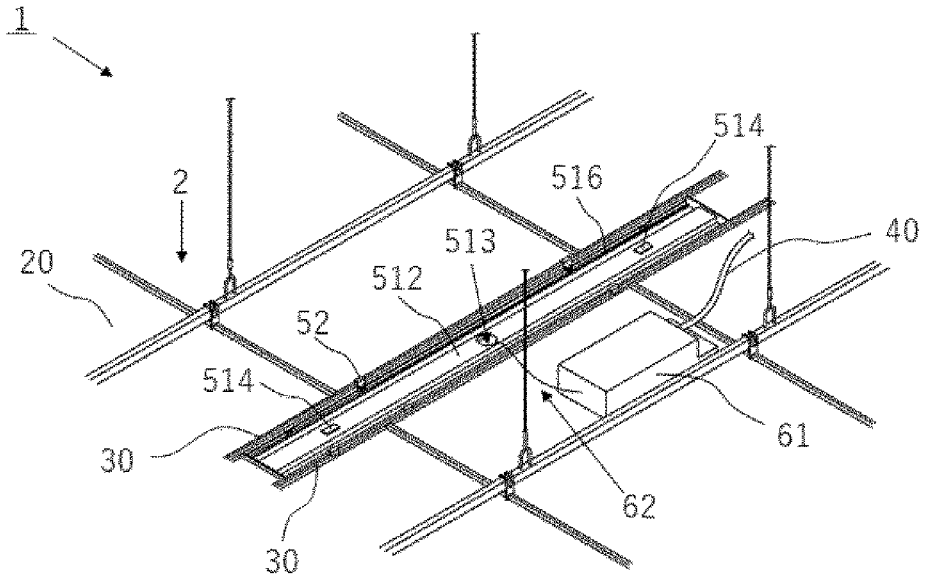
FIG. 12 is a schematic view showing a state in the flow of FIG. 8.

Then, the mounting plate 50 is mounted to the ceiling 2 (step S13). FIG. 11 is a drawing illustrating a state in which the mounting plate 50 is mounted to the ceiling 2 when viewed from the front-side space. FIG. 12 is a drawing illustrating a state in which the mounting plate 50 is mounted to the ceiling 2 when viewed from the back-side space.

The mounting plate 50 is mounted to the opening of the ceiling 2. The mounting plate 50 is mounted to the opening of the ceiling 2 where the lighting fixture 99 is previously mounted. The mounting plate 50 is mounted to the securing members 30. The mounting plate 50 is mounted to the securing members 30 forming the edge of the opening of the ceiling 2.

The mounting plate 50 is mounted to two securing members 30 respectively forming portions of the edge of the opening of the ceiling 2. The mounting plate 50 is mounted to a pair of securing members 30 facing each other. The mounting plate 50 is mounted to the pair of securing members 30 extending in the first direction along the ceiling surface. The mounting plate 50 also may be mounted to other securing members 30.

The fastener 52 of the mounting plate 50 is mounted to the securing member 30. In some implementations, the mounting plate 50 comprises a plurality of fasteners 52. The plurality of fasteners are laterally disposed on each side of the mounting plate in the width direction. The plurality of fasteners 52 of the mounting plate 50 are mounted to the securing member 30. The fasteners 52 are mounted to the securing member 30 in the back-side space. That is, the fasteners 52 are located in the back-side space. The fastener 52 is mounted to the securing member 30 at the hook of the fastener 52.

The mounting plate 50 is mounted to the securing member 30 such that the recessed portion is recessed toward the ceiling space (upward) with respect to the lowermost surface 511. The mounting plate 50 is mounted to the securing member 30 such that the second recessed portion is recessed toward the ceiling space with respect to the recessed portion.

The mounting plate 50 is mounted such that the lowermost surface 511 of the mounting plate 50 is parallel to the ceiling surface. Therefore, the lowermost surface 511 of the mounting plate 50 is located in the same plane as the ceiling surface. In other words, the lowermost surface 511 of the mounting plate 50 serves as a lower surface included in the ceiling surface. The upper surface of the step part 516 is located on the securing member 30. The outer edge of the step part 516 is not exposed when viewed from the front-side space.

The mounting may be performed such that a surface of the mounting plate 50 other than the lowermost surface 511 is aligned parallel to the ceiling surface. For example, with the lowermost surface 511 being a curved surface, the upper surface of the recessed portion may be aligned parallel to the ceiling surface.

A surface of the mounting plate 50 other than the lowermost surface 511 may be included in the ceiling surface. For example, the mounting plate 50 may include an additional lower surface that is located above the lowermost surface 511, and the additional lower surface may be located in the same plane as the ceiling surface. The recessed portion and the second recessed portion are recessed toward the ceiling space with respect to the lower surface of the mounting plate 50 included in the ceiling surface.

The worker can perform the mounting work of the mounting plate 50 in the front-side space. For example, the mounting plate 50 can be mounted by lifting the mounting plate 50 and passing the mounting plate 50 through the opening of the ceiling 2 in a state in which the lowermost surface 511 is tilted with respect to the ceiling surface; and with the entire mounting plate 50 accommodated in the back-side space, the mounting plate 50 is lowered while adjusting so that the hooks of the fasteners 52 catch on the securing members 30. The worker may move into the back-side space and may mount the mounting plate 50 in the back-side space.

As described above, the mounting plate 50 according to the present embodiment is about several kilograms and thus is light, and the work of mounting the fasteners 52 also is simple. Thus, the mounting plate 50 according to the present embodiment have a high safety. In particular, when a worker performs the mounting work in the front-side space, generally, the worker perform the work on a stepladder or the like, and the footing is more unstable than when working on the ground surface. The risk of injury is increased if a heavy object is held in such a state or if the work time is long.

As shown in FIG. 11, it is preferable to place the electrical connection part 62 of the power supply adapter 60 in the front-side space by passing the electrical connection part 62 through the through-hole 513 of the mounting plate 50 when mounting the mounting plate 50 to the ceiling 2 in the work of step S13. Alternatively, rather than in the front-side space, it is preferable to place the electrical connection part 62 proximate to the through-hole 513 of the mounting plate 50 in the back-side space. This allows the worker to hold the electrical connection part 62 of the power supply adapter 60 while the worker is in the front-side space.

Figure 13:
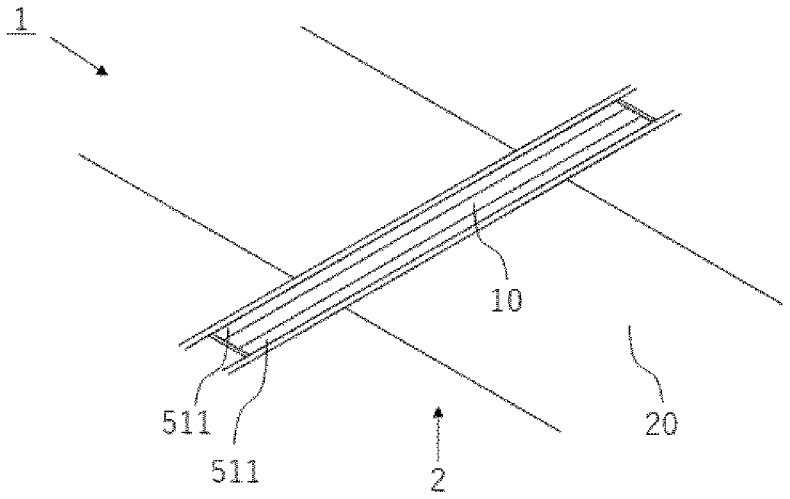
FIG. 13 is a schematic view showing a state in which the lighting fixture according to one embodiment is mounted.

Then, the lighting fixture 10 is mounted to the ceiling 2 (step S14). FIG. 13 shows a state in which the lighting fixture 10 is mounted to the ceiling 2 from the front-side space.

The worker can mount the lighting fixture 10 to the ceiling 2 while being in the front-side space. Electrically connecting the lighting fixture 10 and the power supply adapter 60 and securing the lighting fixture 10 to the mounting plate 50 are performed in the work of mounting the lighting fixture 10 to the ceiling 2.

In the work of electrically connecting the lighting fixture 10 and the power supply adapter 60, the worker connects the electrical connection part 13 of the lighting fixture 10 and the electrical connection part 62 extended from the back-side space through the through-hole 513 of the mounting plate 50 into the front-side space.

By this work, the lighting fixture 10 and the electrical wiring 40 provided in the back-side space are connected via the through-hole 513 provided in the mounting plate 50, so that the lighting fixture 10 is electrically connected. The electrical connection part 13 of the lighting fixture 10 and the electrical connection part 62 of the power supply adapter 60 are connected via the through-hole 513 formed in the mounting plate 50, and the lighting fixture 10 and the power supply adapter 60 are electrically connected.

The safety for electric shock is ensured for the electrical connection part 13 of the lighting fixture 10 and the electrical connection part 62 of the power supply adapter 60, so that the connection work can be performed by a worker that is not an expert worker of electrical work. For example, in compliance with the laws and ordinances of Japan at the time of filing the Japanese Patent Application No. 2020-057423, this connection work is allowed to be performed by a person that does not have the qualification of a licensed electrician.

Either the work of electrically connecting the lighting fixture 10 and the power supply adapter 60 or the work of securing the lighting fixture 10 to the mounting plate 50 may be performed earlier. When the work of securing the lighting fixture 10 to the mounting plate 50 is performed earlier, the worker performs the work of electrically connecting the lighting fixture 10 and the power supply adapter 60 while the worker is in the back-side space. The electrical connection part 62 of the power supply adapter 60 may be located in the back-side space in a state in which the work of step S12 is finished.

In the work of securing the lighting fixture 10 to the mounting plate 50, the worker fits the lighting fixture 10 into the recess defined by the recessed portion of the mounting plate 50. Also, the mounting member 14 of the lighting fixture 10 fits into the recess defined by the second recessed portion of the mounting plate 50. The lighting fixture 10 adheres to the mounting plate 50 by the mounting member 14, and thus is secured to the mounting plate 50. With the mounting member 14 fit into the recess defined by the second recessed portion, the mounting position of the lighting fixture 10 can be stable.

When the plate part 51 of the mounting plate 50 is formed of a magnetic material, the magnet 14 of the lighting fixture 10 can be adhered at any position of the plate part 51. Therefore, the lighting fixture 10 can be mounted at the determined position by a simple mounting work by providing the second recessed portion that corresponds to the shape of the magnet 14 in the plate part 51.

With a structure in which the lighting fixture 10 is mounted by fitting into the recess defined by the recessed portion of the mounting plate 50, bending of the plate part 51 of the mounting plate 50 due to the weight of the lighting fixture 10 can be reduced. The lateral surfaces of the recessed portion contributes to the reduction of the bending.

In the example of FIG. 13, the outer edge of the major irradiation surface of the lighting fixture 10 is located in a plane including the ceiling surface. The major irradiation surface of the lighting fixture 10 and the ceiling surface are located in the same plane. The major irradiation surface of the lighting fixture 10 and the lowermost surface 511 of the mounting plate 50 are disposed along the same plane. The major irradiation surface of the lighting fixture 10 is parallel to the ceiling surface. When viewed from the occupiable room (the front-side space), the major irradiation surface of the lighting fixture 10 and the lowermost surface 511 of the mounting plate 50 are positioned at the same height. The term "same" as used herein can include differences within 2.0 mm.

When the major irradiation surface of the lighting fixture 10 is mounted without protruding downward from the ceiling surface, it is favorable for the depth of the recess from the lowermost surface 511 of the mounting plate 50 to the recessed portion to be in the range of 1.0 cm or greater and 3.0 cm or less. With such a depth, the deformation of the mounting plate 50 can be suppressed by the lateral surfaces of the recessed portion, and the ceiling 2 can appear more like a continuous plane.

Figure 14:
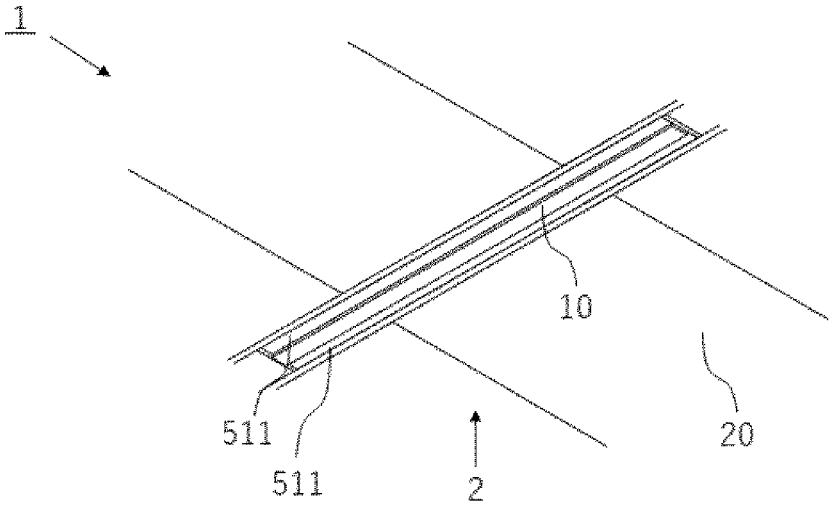
FIG. 14 is a schematic view showing a state in which the lighting fixture according to one embodiment is mounted.

Instead of FIG. 13, the lighting fixture 10 also can be mounted as in the example shown in FIG. 14. In the example of FIG. 14, the outer edge of the major irradiation surface of the lighting fixture 10 is located below the ceiling surface. The major irradiation surface of the lighting fixture 10 is located below the ceiling surface. The lighting fixture 10 protrudes from the recessed portion of the mounting plate 50. The major irradiation surface of the lighting fixture 10 is parallel to the ceiling surface.

When the major irradiation surface of the lighting fixture 10 is mounted to protrude downward from the ceiling surface, it is preferable for the major irradiation surface of the lighting fixture 10 to protrude 0.5 cm or greater from the lowermost surface 511 of the mounting plate 50. With this structure, the irradiation of the light from the lateral surface of the lighting fixture 10 can be utilized as illumination light.

It is preferable for the major irradiation surface of the lighting fixture 10 to protrude from the lowermost surface 511 of the mounting plate 50 by a length equal to or smaller than a length 0.5 cm subtracted from the length in the thickness direction of the lighting fixture 10. With this structure, the recessed portion can be provided in the mounting plate 50, and the deformation can be reduced.

It is preferable for the depth of the recess from the lowermost surface 511 of the mounting plate 50 to the recessed portion to be in the range of 0.5 cm or greater and not more than 2.0 cm. With this structure, the recessed portion allows for reducing deformation of the mounting plate 50, and a compact lighting fixture 10 can be caused to protrude, which can contribute to the weight reduction.

In the manner as described above, the lighting fixture 99 is replaced with the lighting fixture 10 in the building 1. The work can be simplified by performing the replacement work in such a procedure. Also, the workers can be effectively utilized.

Although an example is described in which an existing lighting fixture 99 is replaced, mounting of the lighting fixture 10 may be performed other than in a replacement; the lighting fixture 10 can be mounted when constructing a new building 1. That is, mounting of the lighting fixture 10 described in FIG. 8 may be performed in the installation work of installing the lighting fixture in the equipment installation of step S6. In such a case, the step (step S11) of detaching the existing lighting fixture in the flow shown in FIG. 8 is unnecessary.

In one specific example, the ceiling materials 20 are disposed at the ceiling foundation in the interior construction (step S5), and after performing the process of disposing the power supply adapter 60 in the back-side space (step S12), the mounting of the mounting plate 50 (step S13) and the mounting of the lighting fixture 10 (step S14) are performed in the installation work (step S6).

As described above, the installation operation of the lighting fixture 10 according to the present embodiment can be simply performed compared to a conventional installation operation. Therefore, the installation work of the lighting can be completed in a short period of time.

In the installation operation of the lighting fixture 10 according to the present embodiment, the power supply adapter 60 and the lighting fixture 10 are disconnected and disposed at the ceiling 2 in separate processes. Also, the electrical connection part 62 of the power supply adapter 60 and the electrical connection part 13 of the lighting fixture 10 are connected. In this manner, the work after disposing the power supply adapter 60 at the ceiling 2 can be performed by a worker that is not an expert worker of electrical work, so that the work can be efficiently proceeded.

In the installation operation of the lighting fixture 10 according to the present embodiment, the lighting fixture 10 is mounted via the mounting plate 50 instead of directly mounting the lighting fixture 10 to the securing member 30. Also, the mounting plate 50 has a simple structure. With such a structure, even with difference in the width of the pair of securing members 30 depending on the building 1, changing the width of the lowermost surface 511 of the mounting plate 50 allows adaptation to such difference without changing the size of the lighting fixture 10.

For example, the mounting plate 50 can be appropriately adjusted in length by a simple processing such as bending a steel plate and flexibly processed, so that the mounting plate 50 can be easily adapted to such difference compared to changing the width and/or size of the lighting fixture 10. In particular, the mounting plate 50 according to the present embodiment has good customizability due to the simple structure compared to a conventional structure body mounted to the lighting fixture.

In the installation operation of the lighting fixture 10 according to the present embodiment, the lighting fixture 10 can be secured to the ceiling 2 by mounting a single mounting plate 50 to the securing members 30 and mounting the lighting fixture 10 to the single mounting plate 50. In the mounting method according to the present embodiment, in the building 1 in which the lighting fixture 10 is mounted, the first and second recessed portions of the mounting plate 50 are exposed when viewed from the back-side space. The lighting fixture 10 can be mounted using such a mounting method, which does not need an additional member for concealing the first and second recessed portions of the mounting plate 50, so that the installation operation can be simplified.

Realizing such a simple installation operation allows the worker to perform the work more safely while the worker is in the front-side space. Also, the worker does not need to enter the back-side space to perform the work, so that the work speed also can be accelerated.

In the installation operation of the lighting fixture 10 according to the present embodiment, lightweight members are used in each process, so that the safety of the work can be increased. Also, complex work related to the electrical wiring 40 is unnecessary while performing the mounting work of the mounting plate 50 or after mounting the mounting plate 50; therefore, the time of work performed in an unstable state such as when the worker is on a stepladder, etc., can be reduced.

Although the method according to certain embodiments of the present invention has been described above based on the embodiments described above, the technical idea of the present invention is not limited to the specific embodiments described above. Although examples are illustrated in the embodiments described above in which the lighting fixture according to certain embodiments of the present invention is mounted in an occupiable room, the mounting location is not limited to an occupiable room and may be, for example, a location such as a main entrance or a hall. The front-side space of the ceiling is not limited to an occupiable room, and may refer to a space existing at the side opposite to the ceiling space with the ceiling as the boundary.

The present invention is applicable without requiring that all necessary components in the embodiments described above are sufficiently included. Within the scope of the degrees of freedom of design by one skilled in the art or in the technical field of the present invention, the present invention is applicable even when a portion of the components in the embodiments described above is not recited in the claims; the present specification discloses the present invention on the premise that such portions are included.

The method described in the embodiments described above can be used in the field of construction for constructing and/or repairing various buildings such as office buildings, station premises, etc.

The invention claimed is:

1. A lighting fixture assembly, comprising:

a mounting plate configured to be mounted to a structural body, the mounting plate having a lower side surface configured to receive a light fixture and an upper side surface configured to mount to the structural body, the mounting plate having a first length in a longitudinal direction greater than a second length in a width direction, the mounting plate comprising:

a recessed portion formed in a center portion of the mounting plate and extending longitudinally in the longitudinal direction, the recessed portion having a predetermined depth in a thickness direction that is perpendicular to the longitudinal direction, the recessed portion has a first width in the width direction that is perpendicular to both the longitudinal direction and the thickness direction; and the lighting fixture comprising:

a chassis configured to be fixed to the mounting plate, and a cover configured to be connected to the chassis;

wherein, a distance between an outer surface of the cover and an upper side surface of the chassis in the thickness direction is a first thickness, the predetermined depth equal to or less than the first thickness, and the cover has a second width in the width direction, the first width being equal to or greater than the second width.

2. The lighting fixture assembly of claim 1, wherein the recessed portion further comprises a plurality of second recessed portions each having a depth in the thickness direction when viewed from the lower side surface.

3. A lighting fixture assembly, comprising:

a mounting plate configured to be mounted to a structural body, the mounting plate having a lower side surface configured to receive a light fixture and an upper side surface configured to mount to the structural body, the mounting plate having a first length in a longitudinal direction greater than a second length in a width direction, the mounting plate comprising:

a recessed portion formed in a center portion of the mounting plate and extending longitudinally in the longitudinal direction, the recessed portion having a predetermined depth in a thickness direction that is perpendicular to the longitudinal direction; and the lighting fixture comprising:

a chassis configured to be fixed to the mounting plate, and a cover configured to be connected to the chassis;

wherein a distance between an outer surface of the cover and an upper side surface of the chassis in the thickness direction is a first thickness, wherein the predetermined depth equal to or less than the first thickness, wherein the recessed portion further comprises a plurality of second recessed portions each having a depth in the thickness direction when viewed from the lower side surface, and wherein each of the plurality of second recessed portions is sized to receive a mounting member disposed on the chassis.

4. The lighting fixture assembly of claim 3, wherein the mounting member is a magnet.

5. The lighting fixture assembly of claim 4, wherein the magnet is a neodymium magnet.

6. The lighting fixture assembly of claim 1, wherein the predetermined depth is between about one centimeter and about three centimeters.

7. The lighting fixture assembly of claim 1, wherein the mounting plate has a weight between about one kilogram and about three kilograms.

8. The lighting fixture assembly of claim 1, wherein the lighting fixture has a weight between about 0.5 kilograms and about 1.5 kilograms.

9. The lighting fixture assembly of claim 1, wherein the mounting plate further comprises a first fastener and a second fastener laterally disposed on each side of the mounting plate in the width direction.

10. The lighting fixture assembly of claim 9, wherein the fasteners are integrally molded to the mounting plate.

11. The lighting fixture assembly of claim 1, wherein the first thickness is three centimeters or less.

12. A mounting plate for a lighting fixture configured to be mounted to a structural body, the mounting plate comprising:

a lower side surface configured to receive the light fixture;

an upper side surface configured to mount to the structural body;

a first length in a longitudinal direction greater than a second length in a width direction; and a recessed portion formed in a center portion of the mounting plate and extending longitudinally in the longitudinal direction, the recessed portion having a predetermined depth in a thickness direction that is perpendicular to the longitudinal direction, the recessed portion has a first width in the width direction that is perpendicular to both the longitudinal direction and the thickness direction, wherein the first width is configured to be equal to or greater than a second width in the width direction of a cover of the lighting fixture.

13. The mounting plate of claim 12, wherein the recessed portion further comprises a plurality of second recessed portions each having a depth in the thickness direction when viewed from the lower side surface.

14. The mounting plate of claim 12, wherein the predetermined depth is between about one centimeter and about three centimeters.

15. The mounting plate of claim 12, wherein the mounting plate has a weight between about one kilogram and about three kilograms.

16. The mounting plate of claim 12, wherein the mounting plate further comprises a first fastener and a second fastener laterally disposed on each side of the mounting plate in the width direction.

17. The mounting plate of claim 16, wherein the fasteners are integrally molded to the mounting plate.

* * * * *